United States Patent [19]

Weihrauch

[11] 4,110,870

[45] Sep. 5, 1978

[54] HANDLE MOUNTING FOR CLEANING IMPLEMENTS

[75] Inventor: Georg Weihrauch, Wald-Michelbach, Odenwald, Fed. Rep. of Germany

[73] Assignee: Coronet-Werke Heinrich Schlerf GmbH, Fed. Rep. of Germany

[21] Appl. No.: 775,540

[22] Filed: Mar. 8, 1977

[30] Foreign Application Priority Data

Mar. 10, 1976 [DE] Fed. Rep. of Germany ..... 2609903

[51] Int. Cl.[2] ..... A47B 95/02

[52] U.S. Cl. ..... 16/114 R; 15/145; 403/213

[58] Field of Search ..... 403/208, 213, 274, 212; 15/147 R, 147 B, 154; 16/110 R, 114 R, 115; 30/322, 340

[56] References Cited

U.S. PATENT DOCUMENTS

| | | | |
|---|---|---|---|
| 1,692,110 | 11/1928 | Cave et al. | 403/212 |
| 1,809,254 | 6/1931 | Smith | 30/322 |
| 1,898,698 | 2/1933 | Trompeter | 15/154 |
| 2,520,795 | 8/1950 | Bramming | 403/208 |

*Primary Examiner*—Andrew V. Kundrat
*Attorney, Agent, or Firm*—Craig & Antonelli

[57] ABSTRACT

A handle mounting for cleaning implements (brooms, scrubbers, squeegees or the like) comprises a forked connecting member whose fork arms are at one end securable to the head of the cleaning implement and at the other end, interconnected by a crosspiece, are inserted into one end of a tubular metal stem forming the handle or a portion thereof. The connecting member is secured in the stem by deformation of the latter between the two arms of the fork until the tube wall forms two layers, also by welding. The inserted parts of the fork arms, beyond the deformed end of the tube, are bent so as to bear on opposite faces of the tube wall. A cranked arrangement of the outer ends of the fork arms, for engagement with the cleaning implement, are described.

6 Claims, 4 Drawing Figures

Fig. 2
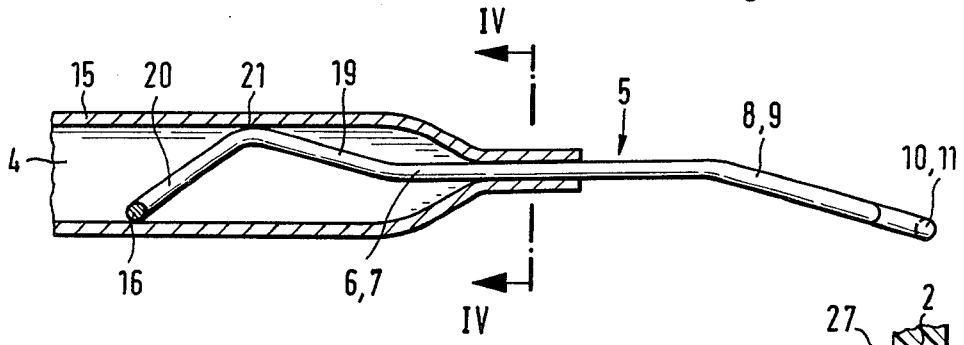
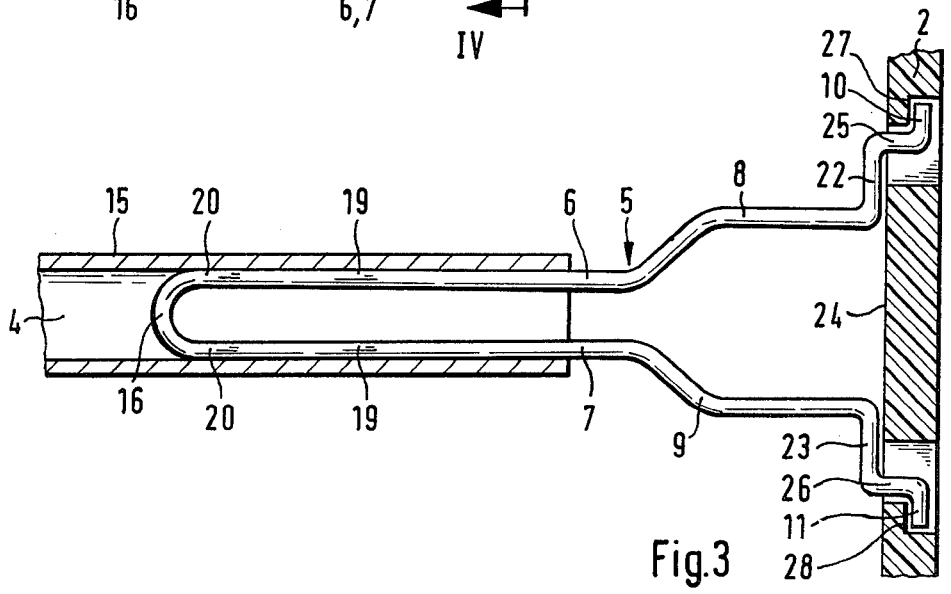
Fig.3
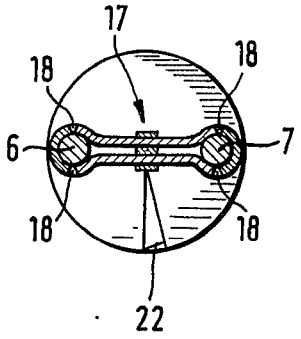
Fig. 4

HANDLE MOUNTING FOR CLEANING IMPLEMENTS

The invention relates to a handle mounting for cleaning implements, for example brooms, scrubbers, squeegees or the like, comprising a forked connecting member of which the free ends of the fork arms can be secured to the head of the cleaning implement and of which the crosspiece connecting the fork arms is inserted and fixed in the end of a tubular metal stem.

Handle mountings of this type are known, for example from Wester German Gebrauchsmuster No. 7 137 877. In this case the free ends of the fork arms are inserted in apertures in the broom or scrubbing brush head. One or more clamping springs, for example hairpin springs, are provided which are supported on the implement head and on the form arms and which clamp the ends of the fork arms in the apertures in the implement head. In addition to this non-positive or clamping connection relying on spring force, there is often a positive or interlocking connection in that the ends of the fork arms are cranked and engage behind the implement head. It has also been proposed that, as an alternative to the separate clamping springs, the form arms themselves should be resilient and should be splayed apart or drawn together by means of a clamping device to generate the securing force.

If wooden handles or other handles of solid material are used, the two fork arms must be produced separately and inserted in the solid material. Alternatively, however, tubular handles are used, in which fork arms interconnected by a crosspiece can be inserted. To this end a known design has a split plug which has recesses for the fork arms at opposite sides of its periphery, and whose plane of separation is approximately in the diametral plane of the fork arms. The plug and the fork arms are together pushed into the hollow end of the handle with a press fit.

Since cleaning implements of this type are exposed in use primarily to compressive and tractive stresses exerted mainly in the direction of the handle axis, the fork arms very soon tend to wobble. Also, the plug may shake loose from the tube after some time.

An object of the invention is to design a handle mounting of the type mentioned in the introduction hereto, which is reliable in operation and, because no additional components are required, is inexpensive.

To this end, according to a first feature of the invention, the end of the tubular stem is deformed between the two arms of the fork until the tube wall forms two layers.

Since the tube wall is deformed between the two fork arms to form two layers, the arms are secured positively, the two-layer arrangement making it impossible for the arms to slip out. Under extreme tractive forces the crosspiece comes up against the two-layer part of the tube wall. In addition the fork arms can be embraced by the tube wall so as to be clamped thereby. The deformation can be produced by simple pressforming or rollforming tools.

Preferably the two layers formed by the tube wall in the two-layer area are interconnected by spot welds. This prevents the tube wall from reverting to an oval shape during use. If the handle is made from a seamed tube, the forked connecting member is inserted in the tube in such a way that the seam is between the fork arms and is welded in this area. This gives the same advantages for a seamed tube as spot welding gives for a drawn tube. A similar procedure may be followed for synthetic plastics tubes.

In addition, the tube wall may be fixed to the fork arms by spot welds in the area adjoining the fork arms.

According to another feature of the invention, those parts of the fork arms which are inserted in the tubular handle are bent in an undulating manner perpendicularly to the plane determined by the two-layer arrangement of the tube wall, and the apex of the bend in the fork arms, on the one hand, and the crosspiece connecting the fork arms, on the other, are supported on approximately opposite points on the tube wall.

This feature has proved to provide a construction which is particularly secure in operation. The fact that the fork arms are supported on opposite points on the tube wall gives optimum transfer of the compressive and tractive forces from the handle to the fork arms and therefore satisfactory transmission to the implement head. This design gives a mounting which cannot work loose even over a long period of use. The bending movements passed from the implement head to the handle during use are absorbed at opposite points in the tube wall.

As indicated in the introduction hereto, some connecting members have substantially parallel fork arms inserted in apertures in the implement head and frictionally secured therein by means of spring force. This frictional engagement, like the attachment of the connecting member to the handle, is liable to work free on account of the tractive and compressive forces, whether because the spring force diminishes with time, because the spring force at the start is too low or not used to the full or because the frictionally engaged surfaces are insufficiently large. A further object of the invention is therefore to provide an improvement at this connecting point also.

To this end, according to a further feature of the invention, the fork arms are bent towards or outwards at their free ends through approximately 90° and engage behind the implement head from below by means of their bent ends.

With this feature, because the fork arms engage behind the implement head, it is impossible to pull the handle or connecting member out of the implement head, as the free ends of the fork arms hook on to the underside of the implement head.

In a further development of this latter construction, according to another feature of the invention, the fork arms are cranked before the transition to the bent free ends so that they bear on the back of the implement head by way of a portion parallel to the back.

In this development the implement head is clamped between the portion bearing on its back and the bend ends, so that neither tractive nor compressive forces are absorbed by the implement head and the connecting member cannot shake loose from the implement head, even if the spring force is too low or the frictional engagement is unsatisfactory. The non-positive connection between the handle and the implement head by virtue of spring force is thus supplemented by a positive or interlocking connection.

Further details and advantages of the invention will be apparent from the ensuing description of an embodiment, by way of example and with reference to the accompanying drawings, in which:

FIG. 2 shows a longitudinal section through the handle end with a connecting member in side view, a clamping device (shown in FIG. 1) being omitted;

FIG. 3 shows a longitudinal section, in a plane perpendicular to that shown in FIG. 2, through the handle end with a connecting member in a modified form, the clamping device being again omitted; and FIG. 4 represents a section on 4—4 in FIG. 2.

Figure 1:
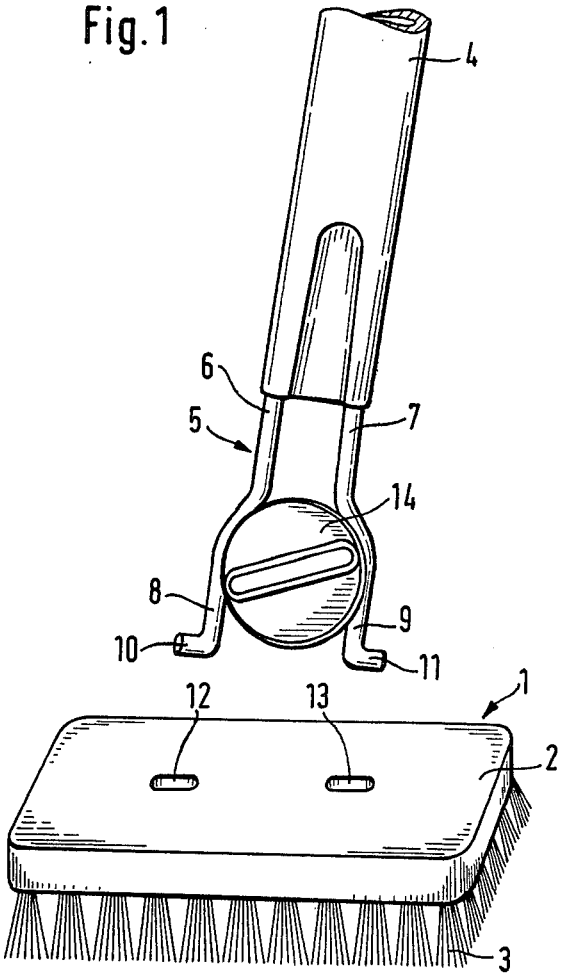
FIG. 1 shows a partial perspective view of a handle mounting before assembly.

FIG. 1 illustrates a cleaning implement 1 in the form of a broom or scrubber comprising a head 2 and bristles or hairs 3. The cleaning implement has a handle 4 provided at its end with a connecting member 5 in the form of a fork with two arms 6, 7. The fork arms 6, 7 are cranked outwards to form parallel portions 8, 9 and are bent outwards at their ends 10, 11. By means of these ends the connecting member 5 engages in apertures 12, 13 in the head 2 of the implement 1. The member 5 is secured by means of a clamping device 14, for example in the form of a cam disc, placed between the portions 8, 9 of the fork arms 6, 7. After the ends 10, 11 have been inserted in the holes 12, 13 in the implement head 2, the cam disc 14 is turned so that the portions 8, 9 are splayed and bear on the walls of the holes, and the bent ends 10, 11 engage behind the head 2 from below.

The handle 4, as best shown in FIGS. 2 to 4, comprises a cylindrical tube 15 in whose open end the connecting member 5 is inserted by means of its two fork arms 6, 7 and the crosspiece 16 which interconnects the arms. The open end of the tube is flattened as shown in FIGS. 2 and 4 so that the tube wall forms two layers between the two fork arms 6, 7 (FIG. 4). The two layers of the tube wall in the two-layer area 17 are interconnected by spot welds or, in the case of a seamed tube as shown in FIG. 4, by a welded seam. In addition the tube wall is fixed to the arms 6, 7 by spot welds 18 in the area embracing these arms. The weld points are preferably so spaced from the tube edge that on the one hand the tube is well closed while on the other hand the welding does not come too close to the edge.

In the preferred embodiment illustrated in FIGS. 2 and 3, those portions of the arms 6, 7 inside the tubular handle are bent in an undulating manner, first one portion 19 being bent in one direction (upwards in FIG. 2) and then another portion 20 being bent in the other direction. The arms 6, 7 are thus supported on one side of the tube wall by the apex 21 of the bend, while the crosspiece 16 bears on an approximately opposite point on the tube wall. This ensures optimum force transmission and also provides additional reinforcement of the tube in the vicinity of the transition to the deformed area.

FIG. 2 also shows that, outside the handle, the connecting member 5 is bent about 30° out of the plane of the fork arms (downwards in the drawing). This bend brings the handle 4 into a more favourable working position relative to the implement head 2.

FIG. 3 illustrates a modified, but preferred embodiment of the connecting member 5. Between the parallel portions 8, 9 of the fork arms 6, 7 and their free, outwardly bent ends 10, 11 there is a double 90° crank, giving a portion 22 or 23 which is approximately perpendicular to the parallel portions and which bears on the back 24 of the implement head 2. If the dimensions of the portions 25, 26 traversing the implement head 2 are suitably selected, it is possible to ensure that the implement head 2 is held fast by the connecting member and cannot work loose at the wrong time. To protect the surface to be cleaned from possible damage due to the bent ends 10, 11, the latter are housed in recesses 27, 28 in the implement head 2.

What is claimed is:

1. Handle mounting for cleaning implements, such as brooms, scrubbers, mops, and the like, comprising a fork-like connecting member having fork legs with free ends, the free ends of the fork legs being attachable to the body of the cleaning implement, and the fork-like connecting element additionally having a bridge connecting the fork legs and being inserted in the end of a tubular metallic handle and being fixed in position within the end of the handle, characterized in that the fork legs extend into the cylindrical part of the tube and are bent in an undulating shape at right angles away from the plane formed by the legs, wherein the apex of the bend of the fork legs on the one hand, and the bridge connecting the fork legs on the other hand, are supported on approximately opposite locations of the tube wall.

2. A handle mounting as claimed in claim 1, wherein the bridge is secured in the handle by the end of the handle being deformed between the fork legs until the handle forms two layers and wherein the two layers formed by the tube wall in the two-layer area are connected by spot welds.

3. A handle mounting as claimed in claim 1, wherein the tubular handle comprises a seamed tube, the connecting member is inserted in said end of the tube in such a way that the seam is between the fork arms, and said layers are welded together in this area.

4. A handle mounting as claimed in claim 1, wherein the wall of the handle is fixed to the fork arms by spot welds in the area adjoining the fork arms.

5. A handle mounting, as claimed in claim 1, wherein the fork leg of the connecting member are substantially parallel and, for insertion of said leg in apertures in the implement head so as to be secured therein non-positively by means of spring force, the fork arms are bent at their free ends through approximately 90° to engage behind the implement head from below by means of their bent ends.

6. A handle mounting as claimed in claim 5, wherein the fork legs are cranked before the transition to the bent ends so that they bear on the back of the implement head by way of a portion parallel to the back.

* * * * *